US008445801B2

(12) United States Patent
Yoshida

(10) Patent No.: US 8,445,801 B2
(45) Date of Patent: May 21, 2013

(54) SWITCH

(75) Inventor: Kousuke Yoshida, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 624 days.

(21) Appl. No.: 12/016,719

(22) Filed: Jan. 18, 2008

(65) Prior Publication Data

US 2008/0173525 A1 Jul. 24, 2008

(30) Foreign Application Priority Data

Jan. 19, 2007 (JP) ..... P2007-010435

(51) Int. Cl.
*H01H 3/12* (2006.01)

(52) U.S. Cl.
USPC ..... 200/341; 200/520

(58) Field of Classification Search
USPC ..... 200/341–345, 510–517, 520
See application file for complete search history.

(56) References Cited

U.S. PATENT DOCUMENTS 7,119,297 B2 * 10/2006 Katagiri ..... 200/345

FOREIGN PATENT DOCUMENTS

| | | | |
|---|---|---|---|
| CN | 1212446 | A | 3/1999 |
| DE | 34 33 719 | A1 | 2/1985 |
| JP | H05-054756 | | 3/1993 |
| JP | H11-96851 | | 4/1999 |
| JP | 2005-044673 | | 2/2005 |
| JP | 2005-44673 | A * | 4/2005 |
| JP | 2006-66102 | | 3/2006 |

OTHER PUBLICATIONS

Translation of JP 2005-44673A printed May 24, 2012, pp. 1-7.*
Official Action issued by Japanese Patent Office on Jul. 26, 2011 in Japanese Application 2007-010435, Filing Date Jul. 19, 2007.
Official Action of the ROC Patent Office in corresponding application 97101747, issued Aug. 30, 2011, 4 pages.

* cited by examiner

*Primary Examiner* — Amy Cohen Johnson
*Assistant Examiner* — Marina Fishman
(74) *Attorney, Agent, or Firm* — Finnegan, Henderson, Farabow, Garrett & Dunner, L.L.P.

(57) ABSTRACT

A switch comprises a room light case, a switch knob arranged inside an aperture portion of the room light case, guide grooves provided on an inner circumferential face of the aperture portion of the room light case, and guide ribs provided on an outer circumferential face of the switch knob. The switch knob moves for a switch stroke part in a depth direction of the aperture portion, from a waiting position to a pressed-down position by a pressing down operation. The guide grooves are provided in a range deeper than a depth size of the switch stroke from an opening edge located on the switch case surface side of the aperture portion.

2 Claims, 7 Drawing Sheets

SWITCH

BACKGROUND OF THE INVENTION

1. Field of the Invention

The present invention relates to a push type switch to be turned ON/OFF by an operation for pressing down a switch knob.

2. Description of the Related Art

A conventional push type switch in which guide grooves are provided on either one of a switch case and a switch knob and guide ribs are provided on the other one of them in order to improve an operation performance of a switch knob has been proposed in Japanese Patent Application Laid Open No. 2006-66102. FIG. 1 to FIG. 3 show one conventional example having such a guiding function.

As shown in FIG. 1 to FIG. 3, a switch 100 has a switch case 101 on which an aperture portion 101*a* is formed, a switch knob 102 arranged inside the aperture portion 101*a*, and a switch portion 103 arranged at a lower side position of the switch knob 102. The switch knob 102 is provided to be freely movable between a waiting position shown in FIG. 2 and a pressed-down position shown in FIG. 3, and stressed toward the waiting position side by a stressing means (not shown).

Also, on an inner circumferential face of the aperture portion 101*a* of the switch case 101, two pairs of guide grooves 110 are formed along a moving direction of the switch knob 102. On an outer circumferential face of the switch knob 102, two pairs of guide ribs 111 to be inserted into the respective guide grooves 110 are provided.

In the above-described configuration, when an operator presses the switch knob 102 down, the guide ribs 111 are moved from the waiting position shown in FIG. 2 to the pressed-down position shown in FIG. 3 while being guided by the guide grooves 110, and the switch portion 103 is turned ON. When the operator releases the pressing down of the switch knob 102, the switch knob 102 returns from the pressed-down position shown in FIG. 3 to the waiting position shown in FIG. 2 while the guide ribs 111 are guided by the guide grooves 110 by the stressing force from the stressing means.

However, in the conventional switch 100 described above, when the switch knob 102 is located at the pressed-down position as shown in FIG. 3, the guide grooves 110 will be exposed from the aperture portion 101*a* of the switch case 101. Consequently, there has been a problem that it is not neat looking.

SUMMARY OF THE INVENTION

The present invention has been achieved in order to resolve the above-described problem, and has an object to provide a switch capable of improving its outward appearance.

An aspect of the present invention is to provide a switch, comprising: a switch case having an aperture portion formed thereon into a sleeve shape; a switch knob provided in the aperture portion, the switch knob slidably arranged between an waiting position where the switch knob is located in a switch case surface side of the aperture portion and a pressed-down position where the switch knob is located in an interior side of the aperture portion by a switch stroke from the waiting position; guide ribs formed along a moving direction of the switch knob, on either one of an inner circumferential face of the aperture portion and an outer circumferential face of the switch knob facing the inner circumferential face; and guide grooves on the other of the inner circumferential face and the outer circumferential face, into which the guide ribs are inserted. Either the guide ribs or the guide grooves are provided in a range deeper than a depth size of the switch stroke from an opening edge located on the switch case surface side of the aperture portion.

According to the above-described configuration, the guide grooves or the guide ribs will not be exposed from the aperture portion of the switch even when the switch knob is at the pressed-down position. Consequently, it is possible to improve its outward appearance.

In addition to the above-described configuration, the switch may further comprises: stopping arms with flexibility, provided on the switch case; and stopping portions to be engaged with the stopping arms, provided on the switch knob. In this case, when the switch knob is inserted inside the aperture portion of the switch case, the switch knob is tentatively attached inside the aperture portion of the switch case as the stopping portions are engaged with the stopping arms.

According to the above-described configuration, the switch knob can be tentatively attached to the switch case, so that it is possible to improve an attaching performance.

Moreover, the switch knob may be a switch unit for turning a car room light ON/OFF, which is arranged inside a car room.

DETAILED DESCRIPTION OF THE EMBODIMENTS

In the following, the embodiments of the present invention will be described according to the drawings. FIG. 4 to FIG. 8 show the first embodiment in which a switch of the present invention is applied to a car room light.

Figure 1:
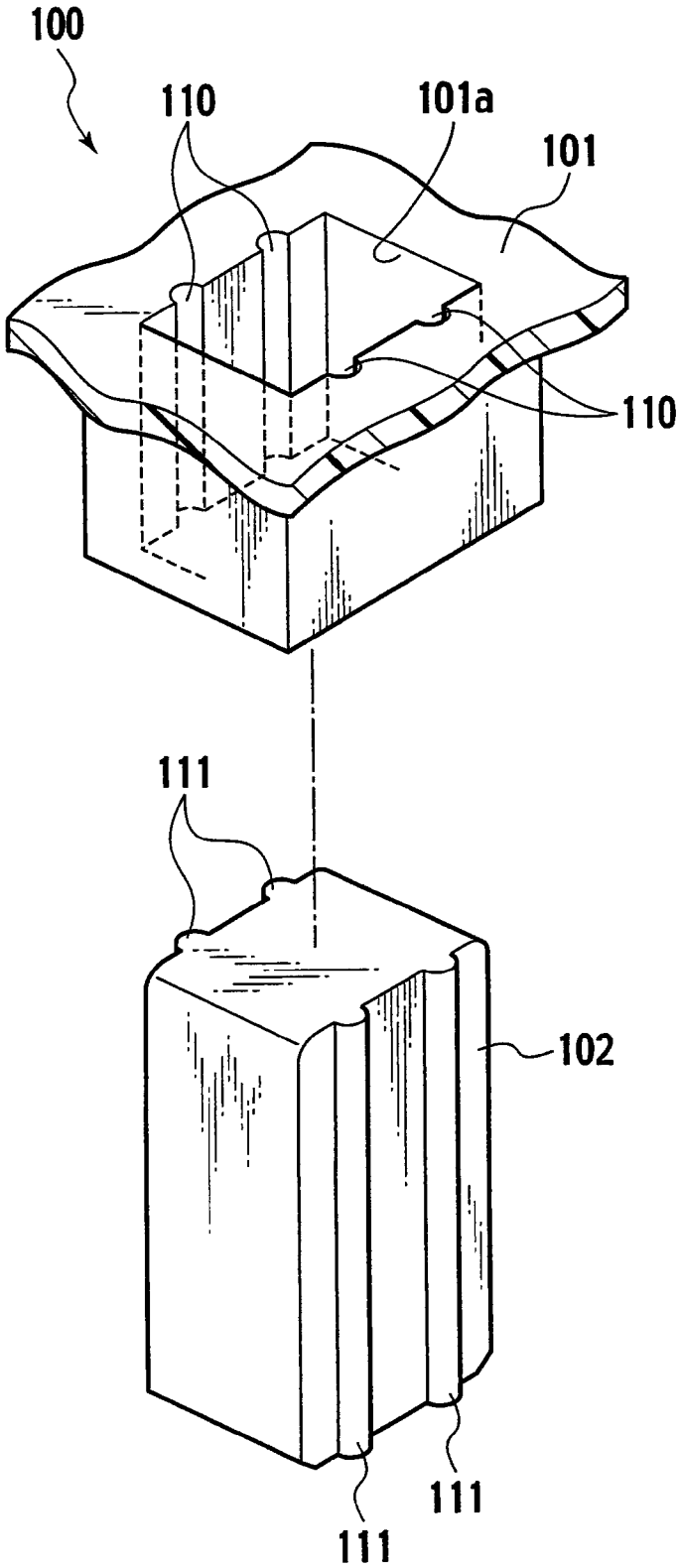
FIG. 1 is an expanded perspective view of a switch knob and a switch case according to a conventional example.
Figure 2:
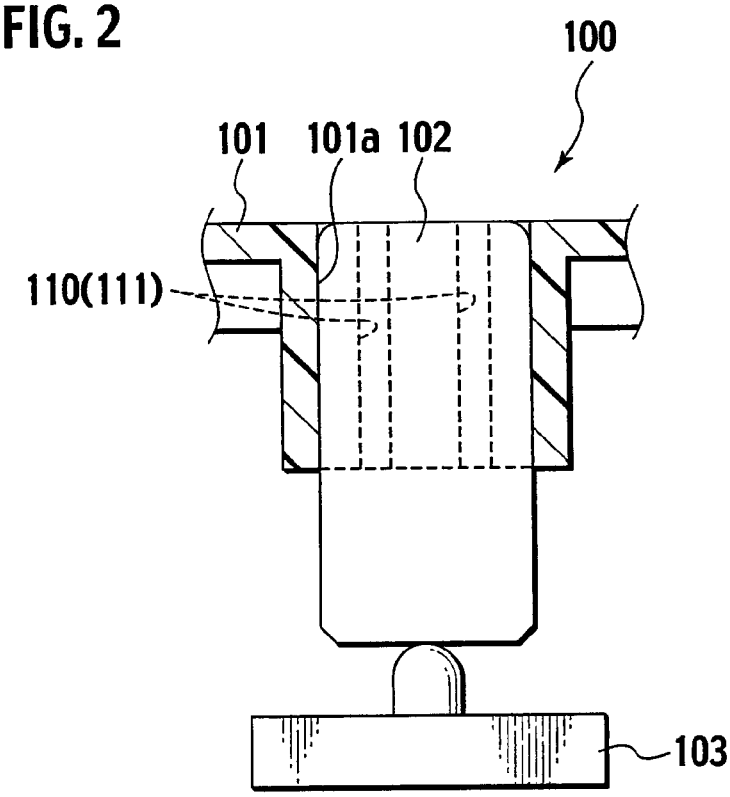
FIG. 2 is a cross sectional view in a case where a switch knob is located at a waiting position, which shows a conventional example.
Figure 3:
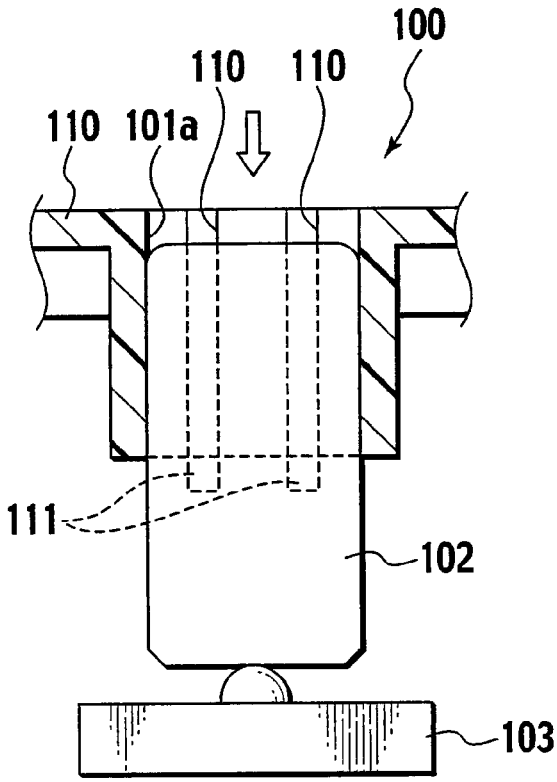
FIG. 3 is a cross sectional view in a case where a switch knob is located at a pressed-down position, which shows a conventional example.
Figure 4:
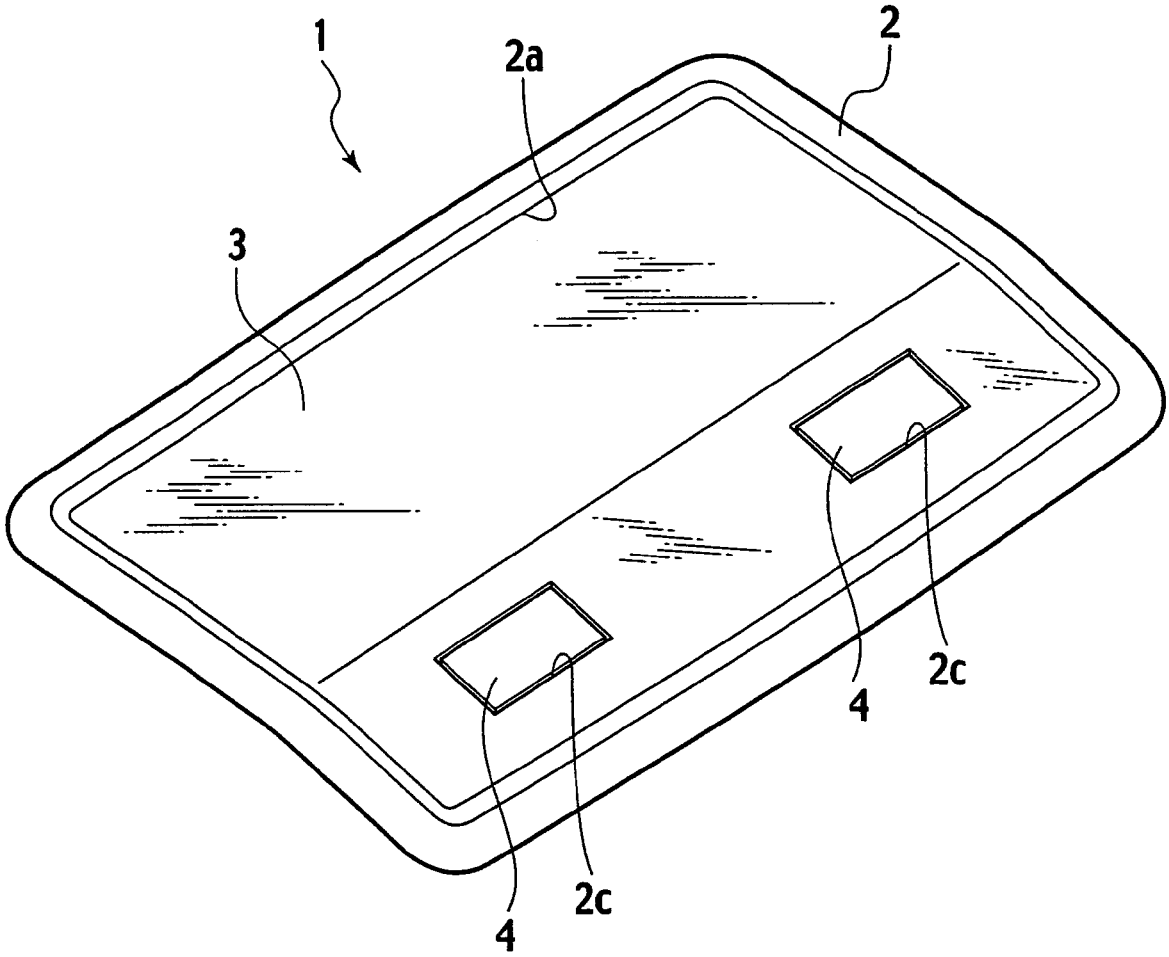
FIG. 4 is an overall perspective view of a car room light, which shows the first embodiment of the present invention.
Figure 5:
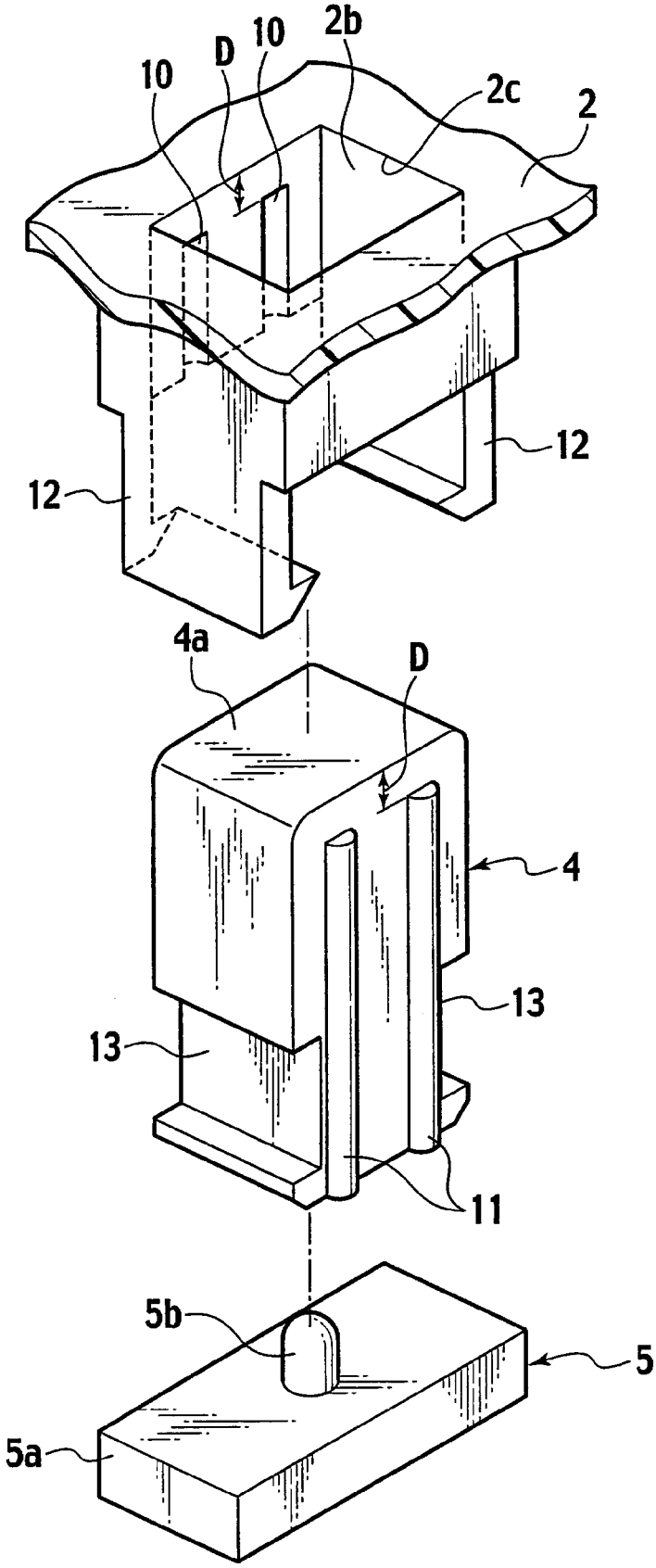
FIG. 5 is an expanded perspective view of a main part of a car room light, which shows the first embodiment of the present invention.
Figure 6:
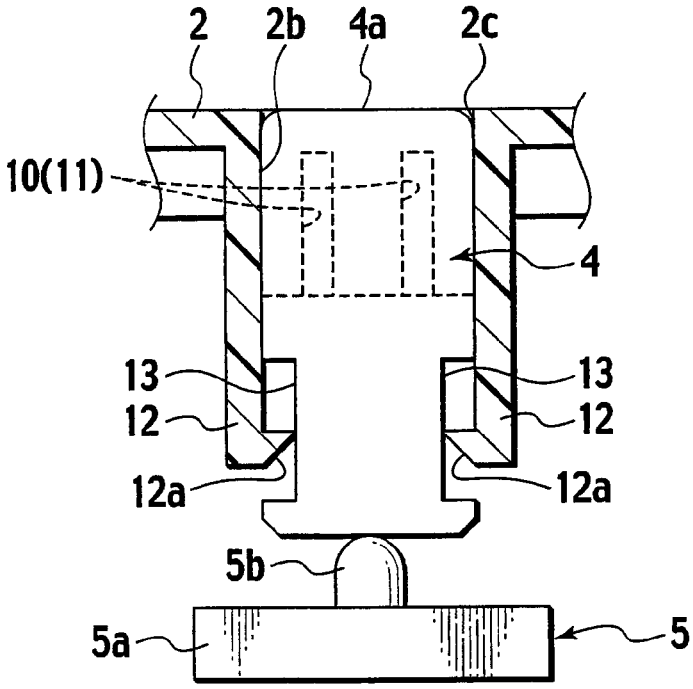
FIG. 6 is a cross sectional view in a case where a switch knob is located at a waiting position, which shows the first embodiment of the present invention.
Figure 7:
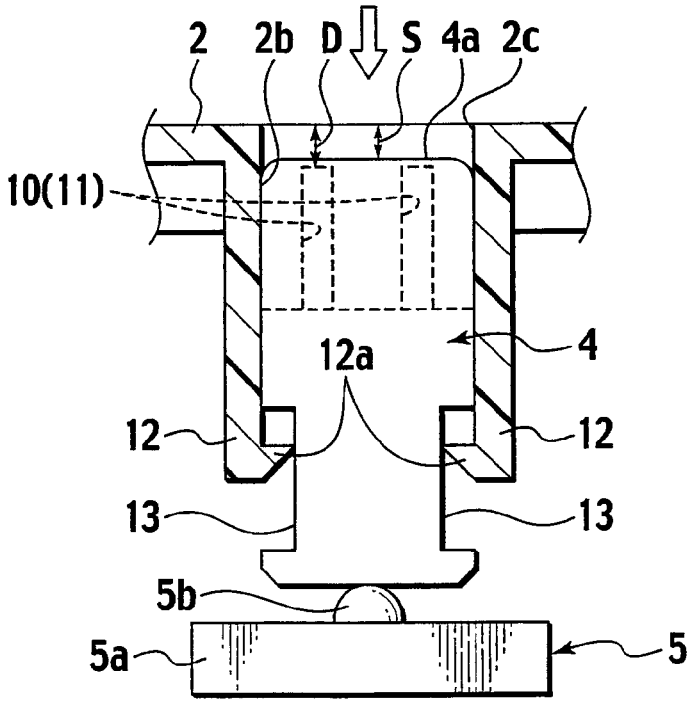
FIG. 7 is a cross sectional view in a case where a switch knob is located at a pressed-down position, which shows the first embodiment of the present invention.

As shown in FIG. 4, a car room light 1 has a room light case 2 which is a switch case to be fixed to a ceiling, for example, inside a car room, a light transparent member 3, switch knobs 4, and switch units 5 (shown in FIG. 5 to FIG. 7). The light transparent member 3 is attached to cover a light transparent window 2*a* of the room light case 2. The switch knobs 4 are respectively arranged within two aperture portions 2*b* of the room light case 2. The switch units 5 are arranged inside the room light case 2, and turned ON/OFF by the respective switch knobs 4. Note that, in this car room light 1, a light source (not shown) for emitting lights through the light transparent member 3 is arranged inside the room light case 2.

As shown in FIG. 5 to FIG. 7, the switch case 2 has an aperture portion 2*b* in a square sleeve shape with a rectangular cross sectional shape, which is opening on its surface. The switch knob 4 is arranged to be freely movable without a gap inside the aperture portion 2*b*, and moves between a waiting position of FIG. 6 and a pressed-down position of FIG. 7. The waiting position of the switch knob 4 set at a position where an operation face 4*a* of the switch knob 4 becomes nearly coplanar with a surface of the room light case 2. The pressed-down position is set at a position where the operation face 4*a* of the switch knob 4 is located inward in an interior direction by a switch stroke S from a surface of the room light case 2. Then, at the pressed-down position, the switch knob 4 will turn the switch unit 5 ON.

On two circumferential faces facing each other on an inner circumferential face in a sleeve shape of the aperture portion 2*b*, two pairs of guide grooves 10 are provided. The guide grooves 10 are formed to be extended along a moving direction of the switch knobs 4. The guide grooves 10 are not provided in a range from an opening edge 2*c* located on a switch case surface side of the aperture portion 2*b* to a depth of the switch stroke S, and provided at positions deeper than that range (D>S). Also, on two outer circumferential faces facing the guide grooves 10 of the switch knob 4, two pairs of guide ribs 11 to be inserted into the respective guide grooves 10 are respectively provided. The guide ribs 11 are not provided in a range from the operation face 4*a* of the switch knob 4 to a depth of the switch stroke S, and provided at positions deeper than that (D>S).

On the aperture portion 2*b*, a pair of stopping arms 12 is provided along a stroke direction of the switch knob 4. Alternatively, a pair of stopping portions 13 to be engaged with the stopping arms 12 is provided on the switch knob 4. The stopping portions 13 are concave portions formed in rectangular shape along the stroke direction of the switch knob 4. Then, stopping hooks 12*a* provided at tip ends of one pair of the stopping arms 12 will engage with one pair of stopping portions 13. In this way, the switch knob 4 will not drop off from the room light case 2, and the stopping hooks 12*a* will slide within the concave portions when the switch knob 4 is operated by pressed-down.

The switch unit 5 has a switch main body 4*a*, a pressing down rod portion 5 protruding on its upper face, and a spring (not shown) which is a stressing means for stressing this pressing down rod portion 5*b* in a protruded direction. The spring is stressing the switch knob 4 toward the waiting position side through the pressing down rod portion 5*b*.

Figure 8:
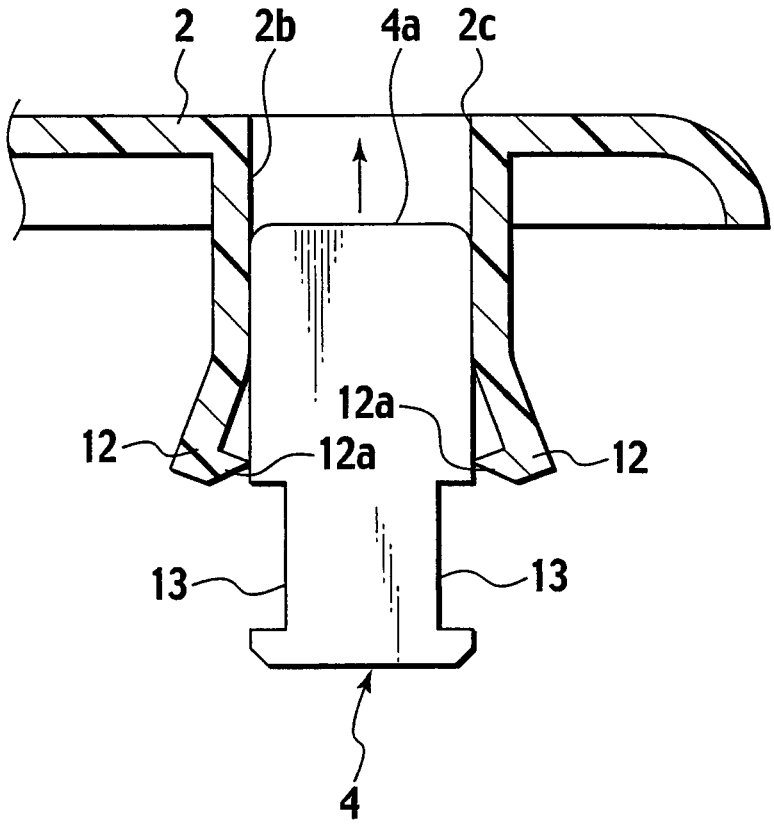
FIG. 8 is a cross sectional view showing a process for attaching a switch knob, which shows the first embodiment of the present invention.

Next, an operation for tentatively attaching the switch knob 4 will be described. As shown in FIG. 8, the switch knob 4 is inserted inside the aperture portion 2*b* from a lower side of the switch case 2. At this point, the stopping arms 12 are bent to outer sides, to permit the insertion of the switch knob 4. When the switch knob 4 is inserted to a vicinity of the pressed-down position, the bending of the stopping arms 12 is released and the stopping hooks 12*a* come into the stopping portions 13, thereby the stopping arms 12 engage with the stopping portions 13. As a result, the switch knob 4 is tentatively attached to the switch case 2. Consequently, it becomes possible to carry out an operation for attaching the switch case 2 to the ceiling or the like inside a car room, without taking a care for dropping off the switch knob 4 from the switch case 2.

In the above-described configuration, when an operator presses down the switch knob 4, the switch knob 4 moves from the waiting position of FIG. 6 to the pressed-down position of FIG. 7, in a state where the guide ribs 11 are guided by the guide grooves 10. Then, the switch unit 5 is turned ON as the switch knob 4 presses down the pressing down rod portion 5*b*.

At the pressed-down position of FIG. 7, when the operator releases the pressing down of the switch knob 4, the switch knob 4 returns from the pressed-down position to the waiting position, in a state where the guide ribs 4 are guided by the guide grooves 10. At this point, the switch knob 4 will return to the waiting position automatically, due to the spring force of the spring (not shown) inside the switch unit 5.

In this embodiment, the guide grooves 10 of the room light case 2 are not provided in a range from the opening edge 2*c* of the switch case surface side of the aperture portion 2*b* to a depth of the switch stroke S, and provided at a range deeper than that. Consequently, as shown in FIG. 7, even in a case where the switch knob 4 is pressed-down to the pressed-down position, the guide grooves 10 will not be exposed from the aperture portion 2*b* of the room light case 2, so that it is neat looking and it is possible to improve the outward appearance. Also, as the guide grooves 10 are not exposed from the aperture portion 2*b* of the room light case 2 in this way, it is possible to prevent an occurrence of a situation in which an operation performance of the switch knob 4 is deteriorated as an external object intrudes into the guide grooves 10.

In this embodiment, one pair of the stopping arms 12 are provided on the room light case 2, k and one pair of stopping portions 13 to be engaged with the respective stopping arms 12 are provided on the switch knob 4. Consequently, it is possible to tentatively attach the switch knob 4 to the room light case 2, so that it is possible to improve the attaching performance.

In this embodiment, the switch knob 4 is stressed toward the waiting position side by the spring force of the spring (not shown) inside the switch unit 5. Consequently, the switch knob 4 will not be shaky, and it is possible to prevent a generation of noises due to vibrations or the like. Note that, in this embodiment, the spring inside the switch unit 5 also plays a role of the stressing means for stressing the switch knob 4 toward the waiting position side, but it is also possible to provide a dedicated stressing means separately.

Figure 9:
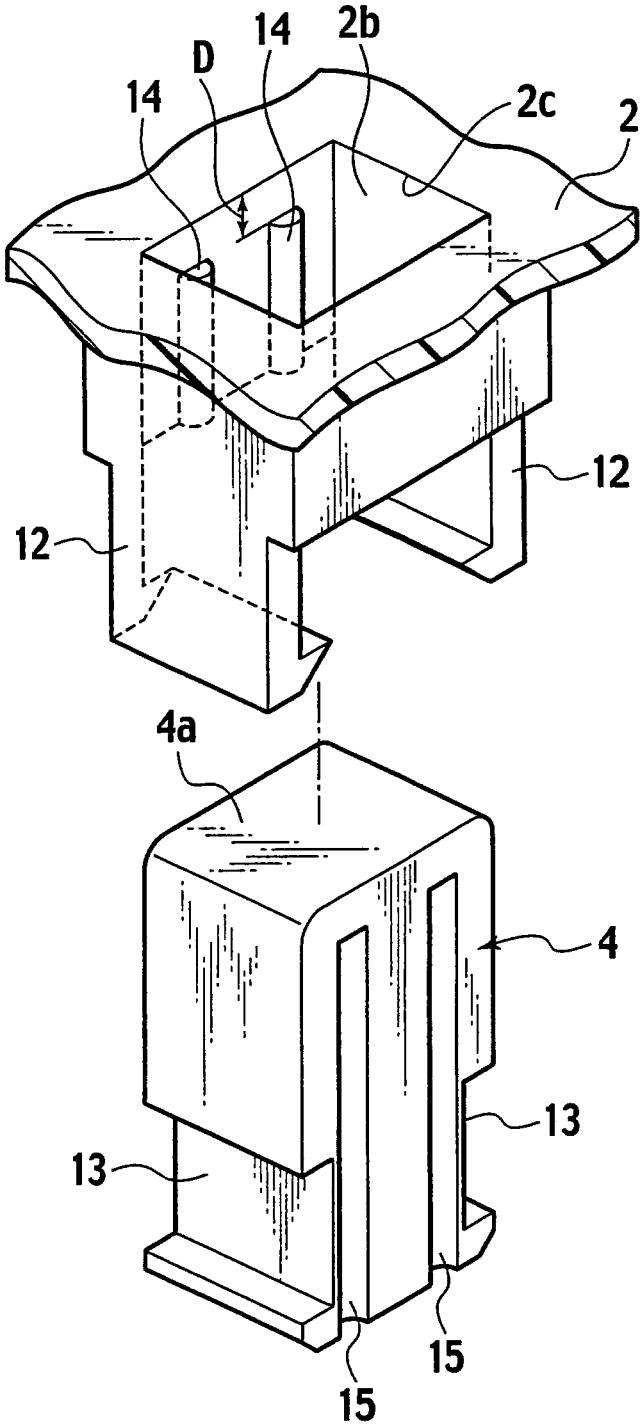
FIG. 9 is an expanded perspective view of a main part of a car room light, which shows the second embodiment of the present invention.

FIG. 9 shows an expanded perspective view of a main part of a car room light according to the second embodiment of the present invention. As shown in FIG. 9, in the second embodiment, contrary to the first embodiment, guide ribs 14 are provided on the inner circumferential face of the aperture portion 2*b* of the room light case 2, and guide grooves 15 are provided on the switch knob 4. Then, the guide ribs 14 are not provided in a range from the opening edge 2*c* located on the switch case surface side of the aperture portion 2*b* to a depth of the switch stroke S, and provided at positions deeper than that (D>S). Also, the guide grooves 15 of the switch knob 4 are provided to be extended to a position in a vicinity of the operation face 4*a* so as to enable a moving of the switch knob 4 between the waiting position and the pressed-down position. However, the guide grooves 15 are not formed to reach to the operation face 4*a* of the switch knob 4.

In the second embodiment, similarly as in the first embodiment described above, even in a state where the switch knob 4 is operated by pressed-down, the guide ribs 14 of the room light case 2 will not be exposed, so that it is possible to improve the outward appearance.

As described above, in the first embodiment, the guide grooves 10 are provided on the room light case 2 side and the guide ribs 11 are provided on the switch knob 4 side. In the second embodiment, the guide ribs 14 are provided on the room light case 2 side and the guide grooves 15 are provided on the switch knob 4 side. As a modification of these cases, it is also possible to provide both of the guide grooves and the guide ribs on the room light case 2 side, and provide both of the guide ribs and the guide grooves on the switch knob 4 side.

Note that, in the first and second embodiments, a case of application to one in which the switch knob 4 turns the switch unit 5 of the car room light 1 ON/OFF has been described, but it is also applicable to one for turning the switch unit other than that of a car room light ON/OFF.

What is claimed is:

1. A switch, comprising:

a switch case having an aperture portion formed thereon into a sleeve shape;

a switch knob provided in the aperture portion, the switch knob slidably arranged between a waiting position where the switch knob is located in a switch case surface side of the aperture portion and a pressed-down position where the switch knob is located in an interior side of the aperture portion by a switch stroke from the waiting position;

guide ribs formed longer in a moving direction than a perpendicular direction of the switch knob, on either one of an inner circumferential face of the aperture portion and an outer circumferential face of the switch knob facing the inner circumferential face;

guide grooves formed on the other of the inner circumferential face and the outer circumferential face, into which the guide ribs are inserted;

wherein the guide ribs or the guide grooves formed on the inner circumferential face of the aperture portion are provided in a range beginning at a depth deeper than a depth size of the switch stroke from an opening edge located on the switch case surface side of the aperture portion and extending to a bottom of the aperture portion;

wherein the guide ribs or the guide grooves formed on the outer circumferential face of the switch knob are provided in a range beginning at a depth deeper than a depth size of the switch stroke from a top edge of the switch knob and extending to the bottom of the switch knob;

wherein the guide ribs are formed opposite the guide grooves;

a pair of stopping arms with flexibility, provided to extend downward from the bottom of the aperture portion;

stopping hooks provided at a bottom of the stopping arms; and stopping portions to be engaged with the stopping hooks of the stopping arms, provided on the switch knob;

wherein when the switch knob is inserted inside the aperture portion of the switch case, the switch knob is tentatively attached inside the aperture portion of the switch case as the stopping portions are engaged with the stopping hooks of the stopping arms.

2. The switch as described in claim 1, wherein the switch knob is a switch unit for turning a car room light ON/OFF, which is arranged inside a car room.

* * * * *